United States Patent [19]

Tymciurak

[11] 4,027,448

[45] June 7, 1977

[54] CRANE BOOM WITH ANGULAR SIDE FRAME REINFORCEMENTS

[75] Inventor: Bohdan Tymciurak, Naperville, Ill.

[73] Assignee: Clark Equipment Company, Buchanan, Mich.

[22] Filed: June 16, 1975

[21] Appl. No.: 587,523

[52] U.S. Cl. ..... 52/632; 52/693; 52/116; 52/117; 212/55; 308/3 R

[51] Int. Cl.[2] ..... E04G 25/00; E04H 12/34

[58] Field of Search ..... 52/111, 115, 116, 117, 52/118, 632, 693; 212/46, 55

[56] References Cited

UNITED STATES PATENTS

| | | | |
|---|---|---|---|
| 1,806,639 | 5/1931 | Moltzan | 52/693 |
| 3,170,198 | 2/1965 | Snider | 52/693 |
| 3,345,792 | 10/1967 | Chandler | 52/693 |
| 3,690,742 | 9/1972 | Sung | 212/55 |
| 3,736,710 | 6/1973 | Sterner | 52/115 |
| 3,793,790 | 2/1974 | Love | 52/693 |
| 3,830,376 | 8/1974 | Fritsch | 212/55 |
| D231,206 | 4/1974 | Spain | D12/54 |

*Primary Examiner*—Price C. Faw, Jr.
*Assistant Examiner*—Robert C. Farber
*Attorney, Agent, or Firm*—Harry G. Thibault

[57] ABSTRACT

A particular arrangement of web stiffening members for the extensible and retractable telescoping sections of a crane boom assembly. A series of web stiffening members are secured to each of the side webs of a telescoping boom section, the web stiffening members being angularly displaced in a particular arrangement on each boom section to provide for reduced stress levels in the section. The web stiffening members are arranged on each side web in two series of members, the innermost stiffener of each series being reversely positioned about a reference point provided on the boom section. The reference point for the boom section corresponds to the point of changeover for shear load for the section under cantilever loading. At the defined reference point of the boom section the innermost stiffener of each series of stiffeners are angularly disposed away from each other to form a V-shaped configuration with the apex of the V directed to the lower or compression flange of each boom section and the remaining stiffeners of each group longitudinally spaced outwardly therefrom in respective parallel, spaced relation. The angular displacement of the stiffeners is derived from a formulation which provides for improved stress levels in the boom section. The formula set forth below provides, $\beta$ angle for the web stiffeners when calculated to minimize the stress level in the web at a given load as follows:

$$\sigma_s(t.f.) = \frac{2K_{tf}\,\tau}{R\tan\beta/2} + (1 - K_{tf})\,\tau\sin\beta$$

Thus the use of the shear loading diagram for a beam under cantilever end loading combined with the formulation providing the optimum stiffener angle results in a stiffener arrangement which produces reduced stress levels in the boom section. The use of the method proposed provides two groups of web stiffeners for each side web of each boom section, arranged in parallel longitudinally spaced relation, each group angularly inclined toward the horizontal at the angle prescribed by the formulation, but reversely positioned on opposite sides of the changeover point.

6 Claims, 8 Drawing Figures

CRANE BOOM WITH ANGULAR SIDE FRAME REINFORCEMENTS

BACKGROUND OF THE INVENTION

1. Field of the Invention

The present invention relates to telescoping crane booms; and more particularly, it relates to an improved arrangement of web stiffening members on the side webs of each of the variably movable boom sections of a crane boom assembly.

The boom sections of a telescoping crane boom may be of any cross sectional configuration but are typically rectangular in transverse cross section. Two or more box shaped boom sections are correspondingly proportioned so that they telescopically slide in each other to provide a boom of appropriate length. Generally, a telescoping crane boom has from two to five nested boom sections. Each boom section comprises a top plate, a pair of side webs extending downwardly from opposite longitudinal edges of the top plate and appropriately secured thereto as by welding and a bottom plate suitably welded to the side webs to close the boom section. In an effort to increase the load carrying capacity and improve the longitudinal stability of the crane boom, reinforcements have been provided in the side webs.

2. Known Systems

Web stiffeners have been deployed on the side walls of the boom section in varying design configurations so as to increase the load carrying capability of the crane boom and to improve its longitudinal rigidity.

For example, as shown in U.S. Pat. No. 3,445,004, issued May 20, 1969 to Grider et al, the web stiffener members are arranged on the side webs of the boom in a lattice configuration which can be described as a simulated Warren truss. Although the simulated Warren truss arrangement does improve the load bearing capability of the crane boom, such a web stiffener arrangement does not substantially improve shear stress capabilities. Further, the simulated Warren truss arrangement fails to provide for changes in load distribution along the length of the boom section and thus would fail to minimize tensile stress in the web and compressive stress in the web stiffeners at all instances of critical load changes along the length of each boom section.

A second form of truss arrangement for the web stiffeners is disclosed in U.S. Pat. No. 3,708,937 issued on Jan. 9, 1973 to Sterner. The Sterner patent discloses a web structure with the web stiffeners mounted on the side webs of the boom in a simulated Pratt truss configuration which comprises a series of vertically oriented web stiffening members arranged in longitudinally spaced relationship along each side web of the boom sections. In the above patent the web stiffening members are shown as appropriately secured to the side webs as by welding and similarly secured to respective top and bottom plates of the boom section in perpendicularly aligned longitudinal spaced relation. However, the simulated Pratt truss configuration also fails to provide adequate protection against shear forces and further does not provide a suitable arrangement to minimize tensile stress in the web and compressive stress in the web stiffeners so as to improve the longitudinal rigidity and the load bearing capability of the crane boom.

SUMMARY OF THE INVENTION

In the present invention, web stiffening members are similarly mounted between the top and bottom plates of each boom section. However, the side webs are disposed angularly along the outer surface of the side webs in spaced relation about a critical shear load changeover point in the boom section as determined from the shear diagram of the boom section under cantilever loading in a particular arrangement to provide improved longitudinal stability and greater load carrying capacity. Two groups of stiffeners are arranged about the critical point of the boom section, with the innermost stiffener of each group intersecting at the critical changeover point of the boom section in a V-shaped configuration with the apex of the V; directed toward the lower or compressive flange thereof, with the remaining stiffeners of each group spaced outwardly therefrom in respective parallel, longitudinally spaced relation. The web stiffening members of each group slant away from a plane transverse to the boom section and perpendicular to the longitudinal axis of the boom assembly which passes through the critical point of the section to form respective oblique angles between the longitudinal axis of the boom assembly and the longitudinal axes of the web stiffeners equal in magnitude but both reversely positioned with respect to the plane through the critical point of the boom section. The efficiency of the arrangement is maximized when the web stiffener angle is greater than 90°, with the optimum angular displacement of the web stiffeners being determined by the following formula for tensile stress in the web, wherein $\beta$ represents the angular displacement of the web stiffeners:

$$\sigma_s\,(t.f.) = \frac{2\,K_{tf}\,\tau}{R\tan\beta/2} + (1 - K_{tf})\,\tau\sin\beta$$

Various theories have been advanced with regard to the maximization of web efficiency, particularly with respect to aircraft structural design. A consideration of the earlier developments as they relate to the present design will be set forth herein.

The improved load bearing capabilities of a boom employing the web stiffening arrangement of the present invention results in the ability to produce a boom section of reduced weight, much higher shear load capability, and substantially improved torsional rigidity.

It is an object of the present invention to provide an improved simulated truss arrangement for web stiffening members, the improved simulated truss arrangement providing greater longitudinal stability and improved weight bearing capacity than can be provided by known structures.

It is a further object of the present invention to minimize stress concentrations in the side webs and the boom stiffeners and improve the overall weight bearing capacity of the boom.

Other features and advantages of the present invention will be apparent to persons skilled in the art from the following detailed description of the preferred embodiment accompanied by the attached drawing wherein identical reference numerals will refer to like parts in the various views.

DETAILED DESCRIPTION OF THE PREFERRED EMBODIMENT

Analytic Development

Figure 1:
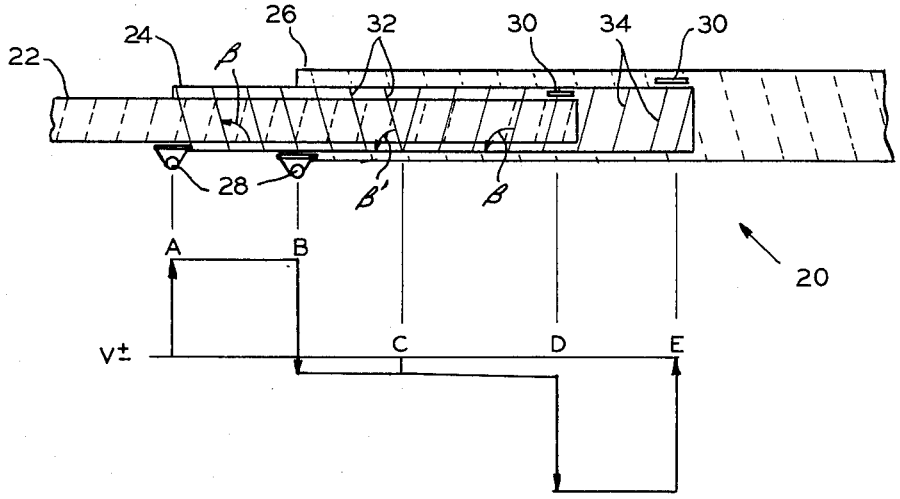
FIG. 1 is a schematic of a partially extended boom assembly for the crane boom of the present invention, the boom assembly being under cantilever end loading (load not shown)

In accordance with the present invention, a particular arrangement of web stiffening members is provided on each of the boom sections of a cantilever mounted crane boom assembly. The basis of the arrangement is the analysis of the stresses which develop in a crane boom assembly during loading. Although the analytic development was directed to aircraft design, I have modified the analysis for application to crane boom structures. The formulae expressed below cannot be considered a full development of the complex stress analysis of cantilever mounted aircraft components and similar structures with like mounting, but is rather a presentation of the basic formulae used in the development of the analysis associated with the present invention.

The use of diagonal tension webs in the analysis of a cantilever mounted web under shear loading was first proposed by Dr. Herbert Wagner in his treatise "Flat Sheet Metal Girders With Very Thin Metal Webs" published (in German) by Zeitschrift fur Flugtechnik und Motorluftschiffahrt, Vol. 20, Nos. 8, 9, 10, 11 and 12, Apr. 29, May 14 and 28, and June 14 and 28, 1929 Verlag von R. Oldenbrough, Munchen - Berlin, and translated to English in the National Advisory Committee for Aeronautics (NACA) Technical Memoranda (TM) Nos. 604, 605 and 606, 1931. Wagner demonstrated that a thin web with transverse stiffeners does not fail as it buckles under loading; it merely forms diagonal folds and functions as a series of diagonal tension members, while the stiffeners acts as compression members. Wagner's analysis, based on "pure diagonal tension," studied the loading characteristics of an arrangement of transverse stiffeners provided on a very thin longitudinal web. Wagner defined diagonal tensile stress as follows:

$$\sigma t_2 = \frac{Z\tau}{R\sin Z\alpha} \qquad (1)$$

Where $\tau = V_h/htw$; that is, the shear stress, $\tau$, is equal to the shear load, $V_h$, divided by web area, $htw$.

Further, 1/R equals the stress concentration factor associated with the flexibility (span) of the flanges and alpha ($\alpha$) equals the diagonal tensile field angle.

For an arrangement of oblique stiffeners, that is, stiffeners oblique to the direction of loading, Wagner derived the following formula for diagonal tensile stress:

$$\sigma t_2 = \frac{2\tau}{R\sin Z\alpha(1 - \tan\alpha \cot\beta} \qquad (2)$$

where beta ($\beta$) is the angle of the stiffeners mounted on the web as measured at the corner through which the diagonal tensile field goes, the angle $\beta$ being either greater or less than 90°. For oblique ($\beta \neq 90°$) stiffeners, the diagonal tensile field angle, $\alpha$, is always equal to $\beta/2$.

Wagner's analysis was based on "pure" diagonal tension and included the following assumptions:

1. The web carried the entire shear load;
2. The flanges were pinned to the verticals and in the case of a cantilever beam were pin-connected at the fixed end of the beam;
3. There was no truss action at the connection of the vertical stiffeners to the flanges; and
4. The web went immediately into the wave state and supported the applied shear entirely by means of the diagonal tension field.

Although it was believed that the "pure" diagonal tension analysis of Wagner would provide reasonable predicted stresses for deep beams with very thin webs, it was found that the Wagner approach was inherently conservative. Thus, the stresses imposed on an aircraft structure during operation could not be analyzed in terms of pure tensile stress. The stress field in the web of an operative assembly should be treated as a mixed field comprising shear stresses and partial diagonal tensile stresses.

A study undertaken by the National Advisory Committee for Aeronautics (NACA) as set forth in technical note (TN) 2661, "A Summary of Diagonal Tension," by Kuhn, Peterson and Levin, 1951, set out to overcome the deficiencies of the Wagner analysis and develop an approach to define the stresses present under bending leads in a web having transverse stiffening members in terms of a mixed or semi-tensile field. Formulae defining the stresses in the web member were developed for a mixed stress field comprising shear stresses and partial diagonal tensile stresses. To further minimize the severe conservatism of the Wagner approach, the analysis used an empirical value known as a tensile field factor, $K_{tf}$, which is a function of the actual shear stress. The tensile field factor, $K_{tf}$, was developed as set forth in NACA TN 1364, "Strength Analysis of Stiffened Beam Webs" by Kuhn and Peterson, 1947. The tensile field factor is defined as follows:

$$K_{tf} = \tanh\left(\log_{10}\sqrt{f_s/f_{scr}}\right) \qquad (3)$$

where $f_s$ equals the actual shear stress (average) and $f_{scr}$ equals the critical (theoretical) buckling shear stress. The NACA approach, which defines the combined shear stress in terms of the tensile field factor, results in the following equation for a web member having substantially vertical stiffeners:

$$\sigma_s(t.f.) = \frac{ZK_{tf}\,\tau}{R\sin Z\alpha} + (1 - K_{tf})\,\tau\sin 2\alpha \quad (4)$$

I have refined these earlier findings and developed their use for unrelated and substantially larger sections which are commonly associated with the crane boom assembly of a large material handling apparatus. Equation (4) above may be modified by the Wagner correction factor for oblique stiffeners taken from equation (2):

$$1-\tan\alpha\cot\beta \quad (5)$$

Recall that for oblique stiffeners only it is found that the diagonal tension field angle, $\alpha$, is always equal to $\beta/2$. Further, the equation (4) includes a left hand component which defines diagonal tensile stress and a right hand component which defines tensil component of actual buckling shear stress. Thus in Equation (4) when $\beta/2$ is substituted for $\alpha$ and Wagner's correction factor is applied only to the left hand component of diagonal tensile stress, the following equation results:

$$\sigma_s(t.f.) = \frac{2K_{tf}\,\tau}{R\tan\beta/2} + (1 - K_{tf})\,\tau\sin\beta \quad (6)$$

The significance of the use of an oblique stiffener arrangement for the web stiffening members wherein the stiffener angle, $\beta$, is greater than 90° can be shown by the following illustration. If the angle $\beta$=110°, tan $\beta/2$=tan 55°, or, 1.428. Thus the tensile field component for an oblique stiffener arrangement is only 70% of the tensile field component for a vertical stiffener arrangement. Note, however, that the carrying capacity of the web increases when the angle $\beta$ is greater than 90° and decreases when the angle $\beta$ is less than 90° since tan $\beta/2$ is greater than 1 only when the angle $\beta$ is greater than 90°. Further, the length of the web stiffeners would become prohibitive unless the angle $\beta$ were limited to a range of 90° to 135°, for example.

Since the angle $\beta$ is always measured at the corner through which the diagonal tensile field goes, you must design the web stiffener arrangement so that the diagonal tensile field always passes through a corner in which the angle $\beta$ is greater than 90°. However, for a multi-section beam connected at respective end portions of adjoining sections, the direction of the diagonal tensile field would change at each of the section connections under end loading conditions.

In a stationary beam, the angle of tilt of the stiffeners could be altered at every reaction or connection point on the beam to minimize the effect of the changes in direction of the diagonal tensile field on the stress levels in the web of the beam. However, in a cantilever mounted crane boom assembly having telescoping sections, upper and lower bearing surfaces or shoes in each section change their relative positions for each extensible length of the boom assembly. Consequently, stress levels at these bearing surfaces or reaction points will change with each partial extension or retraction of the boom assembly. In order to maximize the efficiency of a web stiffener arrangement for the boom sections of a telescoping boom assembly, it is necessary to establish a critical shear load changeover point for each boom section. The critical point is the single point in each boom section at which the direction of the angle of tilt of the web stiffeners change.

The development of the critical stress point for each of the variably movable boom sections of a crane boom assembly is set forth below.

DESCRIPTION OF THE DRAWINGS

Figure 2:
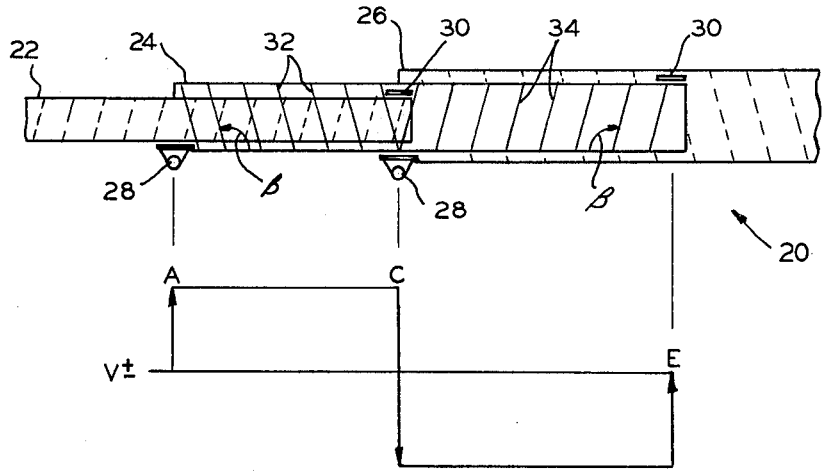
FIG. 2 is a schematic of the boom assembly of FIG. 1 extended about half way.
Figure 3:
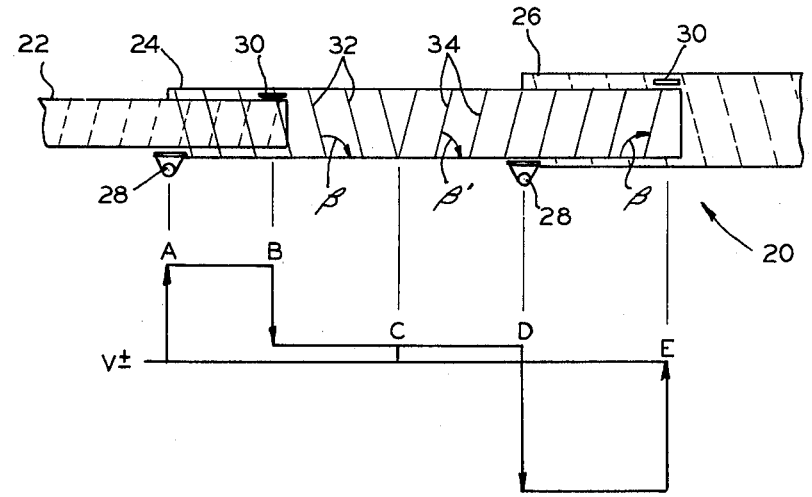
FIG. 3 is a schematic of the boom assembly of FIG. 1 in the fully extended position.

Referring now to the drawings, FIGS. 1 through 3 are schematic drawings which display conditions of shear loading for an intermediate movable section 24 of a boom assembly 20 under end loading conditions similar to that of a boom assembly under a concentrated end load. It can be assumed that similar conditions for shear loading occur in the other variably movable boom sections of the boom assembly 20. In FIG. 1, the boom assembly 20 is partially extended, in FIG. 2 the boom assembly 20 is extended about half way, and in FIG. 3 the boom assembly 20 is fully extended. Telescoping sections 22, 24 and 26 of the boom assembly have respective lower front wear plates or shoes 28 and respective upper rear wear plates or shoes 30 at opposite ends thereof.

With the boom assembly partially extended, as shown in FIG. 1, referring now to intermediate boom section 24, load reactions resulting from a load (not shown) carried at the outer end of the boom assembly occur at points A, B, D and E as shown in the shear diagram associated with the boom assembly of FIG. 1. The regions of the shear diagram defined by segments AB and DE represent the most severe loading conditions whereas the regions defined by segments BC and CD represent relatively low levels of shear loading. Note that the relatively lower level of shear loading for boom section 24 occurs between the point B at which lower shoe 28 of section 26 bears against the bottom plate of section 24 and the point D at which the upper shoe 30 of section 22 bears against the top of section 24.

With the boom assembly 20 extended about half way, as shown in FIG. 2, load reactions occur in the boom section 24 at points A, C and E of the shear diagram associated with the boom section of FIG. 2. The region of the shear diagram defined by segment AC represents a positive shear load and the region defined by segment CE represents a negative shear load. Note that the lower shoe 28 of section 26 is aligned with the upper shoe 30 of section 22, the reaction points associated with the above noted shoes thus coinciding at point C.

With the boom fully extended, as shown in FIG. 3, load reactions again occur in the boom section 24 at points A, B, D and E as shown in the shear diagram associated with the boom section of FIG. 3. The regions of the shear diagram defined by segments AB and DE represent the most severe loading conditions for the boom section 24 whereas the regions defined by segments BC and CD represent relatively low levels of shear loading. Note that the relatively low level of shear loading occurs between the point B at which the upper shoe 30 of section 22 bears against the top plate of section 24 and the point D at which the lower shoe 28 of section 26 bears against the bottom plate of the section 24.

A review of the foregoing figures suggests that the critical shear load changeover point, that is, the point at which the direction of the angle of tilt of web stiffeners mounted on the boom section should be changed is as follows:

For movable sections, the changeover point for the direction of tilt for the web stiffeners mounted on the boom section is located at the changeover point for boom shear from maximum positive to minimum negative shear levels. In FIG. 2, it is at the alignment point of the upper shoe 30 with the lower shoe 28 as shown at point C. Because of the relatively lower levels of shear at the intermediate points of shear changeover shown in FIGS. 1 and 3, the midpoint of the intermediate section 24 serves as a representative changeover point for the movable sections 22, 24, 26 of the boom assembly.

Accordingly, the innermost of web stiffeners 32 and 34 of section 24 should intersect at a vertical plane through point C as shown in FIGS. 1, 2 and 3. The stiffeners 32 and 34 tilt away from the vertical plane to form opposite but equal obtuse angles between the longitudinal axis of the stiffener and the longitudinal axis of the boom section at the corner of the web through which the diagonal tensile field goes, as with the reversely positioned angles, $\beta$, of FIG. 2. The remaining stiffeners 32 and 34 are disposed in longitudinally spaced, parallel relationship with their like-numbered counterparts along the length of the boom section.

The critical changeover point for the fixed boom base section would be the point at which the load is applied to the boom assembly, as at the point through which the hydraulic cylinder raising the boom acts.

In viewing FIG. 1, it is seen that the stiffeners 32 are tilted for maximum load-carrying capacity with the angle $\beta$ greater than 90° ($\beta>90°$) for the positive shear load defined by segment AB and are reversely positioned, that is, the angle $\beta'$ is less than 90° ($\beta<90°$) for the negative shear diagram defined by segment BC, a region of relatively low shear loading. The stiffeners 34 are tilted for maximum load-carrying capacity ($\beta>90°$) for the negative shear load defined by segments CD and DE.

In FIG. 2, the stiffeners 32 and 34 are tilted for maximum load carrying capacity, with the stiffener angle, $\beta$, greater than 90°, as measured at the corner on the web through when the diagonal tension field passes for both stiffeners 32 and 34.

In FIG. 3, the stiffeners 34, while properly tilted ($\beta>90°$) in the region of positive shear loading defined by segments AB and BC of the shear diagram of FIG. 3, are reversely positioned ($\beta'<90°$) in the region of positive shear defined by segment CD, again a region of low shear loading. The stiffeners 34 are properly tilted for the region of negative shear loading defined by segment DE.

Thus, although the alignment of the upper shoe 30 with the lower shoe 28 occurs only at one point in the boom extension cycle of the telescoping boom assembly, placing the changeover point of web stiffening members 32 and 34 at this critical point for each boom section represents an optimum configuration for the loading conditions of the boom assembly. That is, the highest stress levels for the webs occur only where the orientation of the stiffeners is proper, thus maximizing the efficiency of the web structure.

Figure 4:
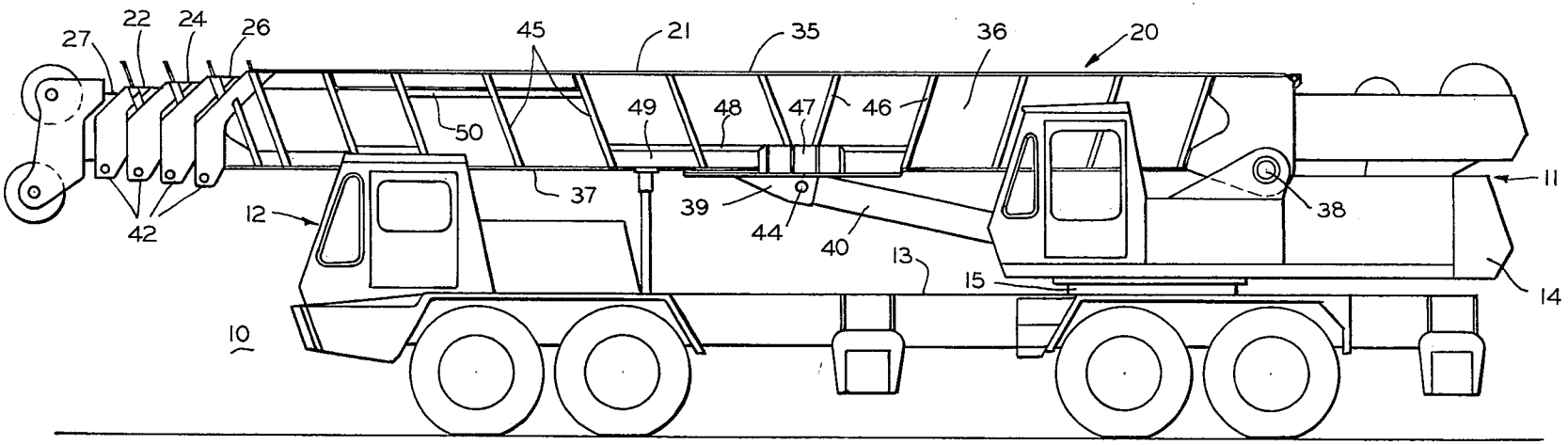
FIG. 4 is a side elevational view of the crane boom of the present invention, showing the boom sections in the fully retracted position with the boom assembly mounted on a crane superstructure carried by a truck trailer bed.

Considering now the preferred embodiment of the present invention, in FIG. 4 reference numeral 10 generally designates a large mobile material handling apparatus including a crane generally designated 11 mounted on a wheeled vehicle 12.

The vehicle 12 includes a horizontal flatbed 13 on which a crane superstructure 14 is mounted by means of a swing circle or slue ring generally designated 15. The swing circle 15 is provided with bearings to permit rotation of the superstructure 14 about a vertical axis.

The crane superstructure includes a telescoping boom assembly 20 having a boom base section 21, and extensible boom sections 22, 24, 26 and 27 including the main boom section 26, an intermediate boom section 24, a power outer boom section 22, and a manual outer boom section 27. Each of the boom sections 21, 22, 24, 26, and 27 are rectangular in cross section for the embodiment shown herein and possess a number of common structural features which will be described in detail below.

Figure 5:
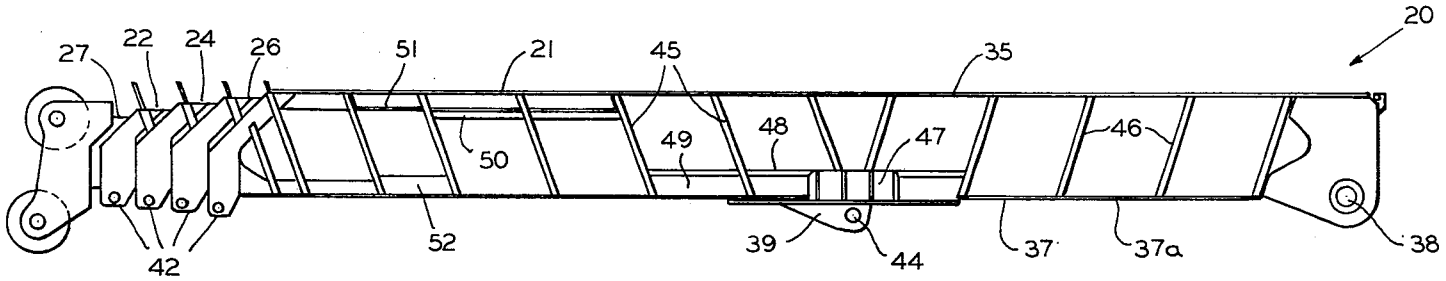
FIG. 5 is a side elevational view of the boom assembly shown on FIG. 4.

Referring now to FIG. 5, the boom base section 21, which is the outermost of the boom sections, comprises an elongated top plate 35 and relatively thin elongated sidewalls or webs 36 which extend downwardly from opposite longitudinal edge portions of the top plate. The side webs 36 are generally perpendicular to the top plate 35. The lower longitudinal edges of the side webs 36 engage a bottom plate 37 to close the bottom section 21. The top plate 35, the side webs 36 and the bottom plate 37 are appropriately secured together as by welding.

The boom base section 21 has provided at a rear end portion thereof a suitably reinforced main pivot unit 38 for the entire boom assembly which is attachable in a known manner to the superstructure 14. The boom base section 21 also has a reinforced connector or center support 39 suitably secured to the bottom plate 37 near the mid point of the section 21 for receiving one end portion of a hydraulic lifting cylinder 40 for the crane. At the forward end of the boom base section 21 is provided an underslung transverse box member 42 which receives the lower forward wear plates or shoes 28 in the conventional holders.

A first series of web stiffeners 45 and a second series of web stiffeners 46 are mounted on the boom base section 21 as shown in FIGS. 1 and 2. The web stiffeners 45 and 46 are mounted on the boom section so as to maximize the load carrying efficiency of the boom. Thus, as stated above, the angle between the longitudinal axis of the boom and the axis of the web stiffeners, beta ($\beta$), must be greater than 90° when measured at the web corner through which the diagonal tension field goes.

In the boom base section the critical load point or shear change-over point is a pivot 44 at the center support 39. At the critical changeover point the innermost stiffener 45 of a first set of stiffeners 45 intersects the innermost stiffener 46 of a second set of transverse stiffeners 46 at a lower or compressive flange 37*a* associated with the bottom plate 37 of the boom section 21. Because the angle $\beta$ is the same for both the stiffeners 45 and the stiffeners 46, stiffeners 45 and 46 diverge from the critical changeover point of the boom base section at equal angles from the vertical axis thereof. The remainder of stiffeners 45 and 46 are disposed outwardly of the intersecting inner stiffeners 45,46 in respective parallel longitudinally spaced relationship.

Additional side plate reinforcing means are provided on the side webs 36 to resist buckling stresses in the boom sections. A side plate reinforcing member 47 is provided adjacent the center support 39 in the boom base section 21 to reinforce the boom about the center support 39, an obvious critical point of stress. The side member 47 is longitudinally disposed along the side web 36 with its lower longitudinal edge engaging bottom plate 37 of the boom section 21. In addition, a longitudinal web stiffening member 48 abuts the side plate reinforcing member 47 and is disposed in the longitudinal direction of the side webs 36. A doubler plate 49 is also disposed between the member 48 and the bottom plate 37 of the boom base section 21. Additional longitudinal web stiffening members 50 are provided in an upper portion of the side web 36 of the boom section 21 as shown in FIGS. 4 and 5. Additional doubler plates 51 and 52 are provided at respective upper and lower frontal edges of the side webs 36 of the boom base section 21. The web stiffening members 48 and 50 comprise channel shaped members and are similar in cross section to the web stiffening members 45 and 46.

Figure 6:
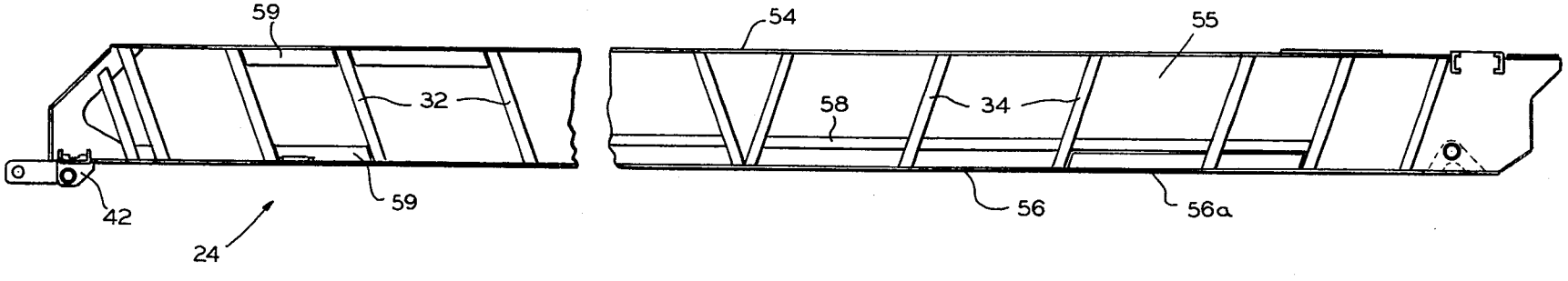
FIG. 6 is a side elevational view of the intermediate boom section of the boom assembly.

The extensible intermediate boom section 24 is shown in detail in FIG. 6 and extensible sections 22 and 26 are configured similarly thereto. Because there is no obvious load application point for the variable movable sections, such as the center support 39 of the boom base section 21, the changeover point for web stiffeners 32 and 34 is determined by the analysis set forth above. Intermediate boom section 24 comprises an elongated top plate 54 having relatively thin elongated side webs 55 extending downwardly from the opposite longitudinal edges of the top plate 54. Lower longitudinal edges of the side webs 55 engage a bottom plate 56 to close the intermediate boom section 24. The top plate 54, the side webs 55 and the bottom plate 56 are secured together, as by welding.

Web stiffeners 32 and 34 are mounted on the boom section 24 as shown in FIG. 6, with the innermost of stiffeners 32 and 34 intersecting in a V-shaped configuration at compressive flange 56*a* of the bottom plate 56 of the boom section 24. The point of intersection of stiffeners 32 and 34 is the shear load changeover point for the boom section as determined above. The changeover point for variably movable boom sections is typically near the midpoint of the boom section. Variably movable boom sections 22 and 26 are constructed similarly with a similar arrangement of web stiffeners mounted on the side webs of the boom sections for each of the boom sections 22 and 26. Longitudinal stiffening members, such as members 58 and 59 mounted on the side webs 56 of the boom section 24, may also be provided on the side webs of the boom sections 22 and 26. The members 58 and 59 are added to the side webs of the boom sections to alleviate local buckling conditions.

Figure 7:
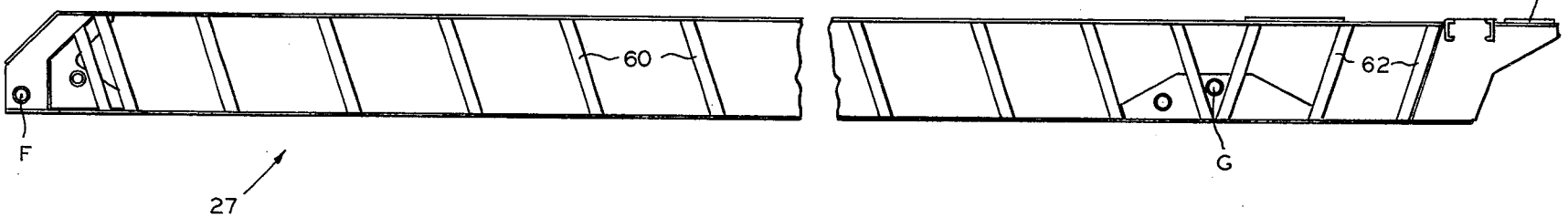
FIG. 7 is a side elevational view of the manual outer boom section of the boom assembly.
Figure 8:
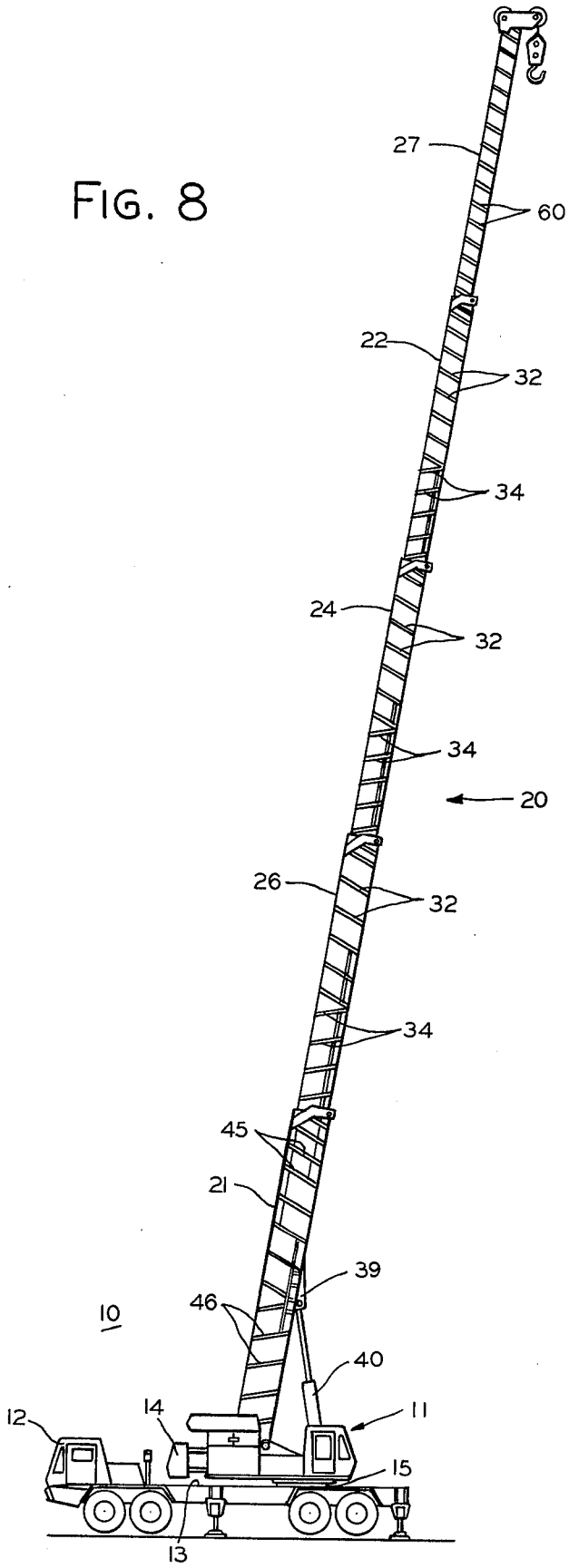
FIG. 8 is a side elevational view of the boom assembly of FIG. 4 in the upright and fully extended operating position.

Although the changeover point for each of the variably movable boom sections 22, 24 and 26 is near the center of the respective boom section, it should be recognized that the location of the changeover point is dependent on the load profile of the boom section. For example, for the manually extended outer boom section 27 shown in FIG. 7 the load changeover point is based on a fully extended boom loading position. Consequently, load reactions occur at the outer end of the boom section, as at point F, at the support point G, and at the upper shoe location H. Web stiffeners 60 and 62 diverge from the support point G in an arrangement similar to that for the variable boom sections 22, 24 and 26. However, because the load reaction point G is near the inner end of boom section 27, the reversely positioned stiffeners 62 are not visible in FIG. 8, wherein the fully extended working position of the boom assembly 20 is shown.

The terms and expressions which have been used to set forth the preferred embodiment of the present invention are intended as words of description and not of limitation, and there is no intention, in the use of such terms and expressions, of excluding any equivalents of the features shown and described or portions thereof but it is recognized that various modifications are possible within the scope of the appended claims.

I claim:

1. For a large material handling apparatus comprising a telescoping crane boom assembly having two or more extensible and retractable sections, each section comprising a longitudinal top plate, a pair of side webs extending downwardly from opposite longitudinal edges of the top plate and appropriately secured thereto, a bottom plate appropriately secured to the lower edges of the side webs to provide a lower or compression flange and to close the boom section, and web stiffeners rigidly secured to the side webs in longitudinally spaced relation and extending between the top and bottom plates of the boom section, an arrangement of web stiffeners mounted on each side web of each extensible and retractable boom section, the arrangement comprising first and second pluralities of web stiffeners, each stiffener of the first plurality of web stiffeners being mounted on the web at a first angle of tilt in longitudinally spaced relation and directed toward the front of the boom section, each stiffener of the second plurality of web stiffeners being mounted on the web at a second angle of tilt in longitudinally spaced relation and being directed toward the rear of the boom section, with the innermost stiffener of each of the first and second pluralities of stiffeners intersecting at a changeover point generally provided at a midpoint of the boom section, the apex of the intersecting stiffeners being directed to the compression or lower flange of the boom section, the changeover point generally corresponding to the changeover from positive to the negative shear in a movable boom section under cantilever end loading.

2. An arrangement of stiffeners as claimed in claim 1 wherein opposite ends of each stiffener are also rigidly secured to respective top and bottom plates of the boom section.

3. The arrangement of stiffeners as claimed in claim 1 wherein the first angle of tilt for each stiffener for the first plurality of web stiffeners is equal to the second angle of tilt for each stiffener of the second plurality of web stiffeners, with said first and second angles reversely positioned on opposite sides of the changeover point.

4. The arrangement of web stiffeners as claimed in claim 1 wherein the first and second angles of tilt are greater than 90° when measured from the longitudinal axis of the boom section to the longitudinal axis of the stiffener, such angle being measured counterclockwise for the stiffeners directed to the front of the boom section and clockwise for the stiffeners directed to the rear of the boom section.

5. The arrangement of web stiffeners as claimed in claim 1 wherein the first and second angles of tilt are greater than 90° but less than 135° when measured from the longitudinal axis of the boom section to the longitudinal axis of the stiffener, such angle being measured counterclockwise for stiffeners directed to the front of the boom section and clockwise for stiffeners directed to the rear of the boom section.

6. The arrangement of stiffeners as claimed in claim 1 wherein a plane transverse to the longitudinal axis of the boom section passes through the critical changeover point, a pair of web stiffeners intersect at a compressive flange of the plates abutting the web to form a V-shaped configuration at the critical changeover point, with respective first and second pluralities of web stiffeners associated with respective first and second stiffeners of the pair of intersecting web stiffeners and spaced outwardly therefrom allochirally with respect to the critical changeover point along each side web of the boom section in parallel longitudinally spaced relationship.

* * * * *

UNITED STATES PATENT OFFICE

CERTIFICATE OF CORRECTION

Patent No. 4,027,448 Dated June 7, 1977

Inventor(s) Bohdan Tymciurak

It is certified that error appears in the above-identified patent and that said Letters Patent are hereby corrected as shown below:

Column 3, equation (1), that portion of the equation reading " $\frac{ZT}{R\sin Z\alpha}$ ", should read -- $\frac{2T}{R\sin 2\alpha}$ --;

Column 4, line 1, that portion of the equation reading "htw" should read --$ht_w$--;

line 2, change "htw" to --$ht_w$--;

equation (2), that portion of the equation reading

" $R\sin Z\alpha(1-\tan\alpha\cot\beta$ ", should read -- $R\sin 2\alpha(1-\tan\alpha\cot\beta)$ --;

Column 5, equation (4), that portion of the equation reading " $\frac{ZK+P\,T}{R\sin Z\alpha}$ ", should read -- $\frac{2K+f\,T}{R\sin 2\alpha}$ --;

line 19, change "tensil" to --tensile--.

Signed and Sealed this

Eighth Day of August 1978

[SEAL]

Attest:

RUTH C. MASON
*Attesting Officer*

DONALD W. BANNER
*Commissioner of Patents and Trademarks*